US005976358A

United States Patent [19]

Sartori et al.

[11] Patent Number: 5,976,358

[45] Date of Patent: Nov. 2, 1999

[54] REMOVAL OF +2 ION CHARGED METAL DISSOLVED IN A PETROLEUM FEED

[75] Inventors: Guido Sartori, Annandale; David W. Savage, Lebanon; Saul C. Blum, Edison; Bruce H. Ballinger, Bloomsbury, all of N.J.

[73] Assignee: Exxon Research and Engineering Co., Florham Park, N.J.

[21] Appl. No.: 09/036,078

[22] Filed: Mar. 6, 1998

Related U.S. Application Data

[63] Continuation of application No. 08/726,015, Oct. 4, 1996, abandoned.

[51] Int. Cl.[6] ..... C10G 25/06

[52] U.S. Cl. ..... 208/251 R; 208/299

[58] Field of Search ..... 208/251 R, 299

[56] References Cited

U.S. PATENT DOCUMENTS 4,457,847 7/1984 Lorenc et al. ..... 210/698

*Primary Examiner*—Helane Myers
*Assistant Examiner*—Nadine Preisch
*Attorney, Agent, or Firm*—Ronald D. Hantman

[57] ABSTRACT

The present invention is a process to remove a +2 ionic charged metal from a petroleum feed. The process includes contacting the feed with a resin that includes carboxyl, sulfonic and/or phosphonic groups. In a preferred embodiment the metal is a Group II metal. In particular, the metal is calcium.

12 Claims, No Drawings

REMOVAL OF +2 ION CHARGED METAL DISSOLVED IN A PETROLEUM FEED

This is a continuation of application Ser. No. 08/726,015, filed Oct. 4, 1996, now abandoned.

BACKGROUND OF THE INVENTION

The present invention relates to a process to remove certain metals from crude oil. In particular, the metal is calcium.

Calcium present in crudes can lead to fouling of heaters and heat exchangers and poison catalysts used in crude processing. Therefore, Ca-rich crudes are less valuable than crudes with low Ca. A process for Ca removal enables the increase of the value of such crudes. This invention is particularly valuable when a Ca-rich crude is processed in a corrosion-resistant environment, where the increase in acidity accompanying the process of the present invention is not a drawback.

SUMMARY OF THE INVENTION

The present invention is a process to remove a +2 ionic charged metal from a petroleum feed. The process includes contacting the feed with a resin that includes carboxyl, sulfonic and/or phosphonic groups. In a preferred embodiment the metal is a Group II metal. In particular, the metal is calcium.

DESCRIPTION OF THE PREFERRED EMBODIMENT

The present invention is a process to remove +2 ionic charged metals from a petroleum feed. The metals include Ca, Mg, Mn, and Zn. Calcium is particularly important. The process includes contacting the feed with a resin that includes carboxyl, sulfonic and/or phosphonic groups. These metals may be in several forms, including naphthenates, phenolates, chlorides or sulfates.

The resins can contain carboxyl, sulfonic or phosphonic groups. Preferably, the resins are crosslinked, therefore not soluble in the crude. Suitable resins are sulfonated styrene-divinylbenzene copolymers, methacrylic acid-divinylbenzene copolymers, polyacrylic acid, polyvinylsulfonic acid, phosphorylated styrene-divinylbenzene copolymers, polymethacrylic acid and styrene-divinylbenzene copolymers with attached iminodiacetic acid groups.

The resin can be in the form of a bed through which the crude is passed; otherwise, the resin can be suspended in the crude and separated at the end of the treatment by filtration or centrifugation. The temperature at which the treatment occurs should be high enough to reduce the viscosity of the crude and low enough to avoid decomposition of the resin. A temperature between 50 and 150° C. is generally satisfactory.

After use, the resins can be regenerated by acid treatment.

The following examples illustrate the invention without limiting it.

EXAMPLE 1

The reaction apparatus was a glass vessel equipped with stirrer and reflux condenser, immersed in an oil bath. 50 g of Kome 6/1 crude, containing 930 ppm of Ca, 42 ppm of Mn and 2.6 ppm of Zn were put into the reactor. 15.6 g of sulfonated styrene-divinylbenzene copolymer, known under the commercial name of Amberlite IR-120 and having a capacity of 1.9 milliequivalents/ml, were added.

The mixture was stirred at 70° C. for 7 hours. Then the solid was separated by centrifugation and the treated crude was analyzed for metals. The contents of Ca, Mn and Zn had dropped to 107, 4.9 and 0.9 ppm respectively.

Infrared spectroscopy showed that the band at 1708 $cm^{-1}$, corresponding to the carboxyl group, is more intense than in the untreated crude and the band at 1600 $cm^{-1}$, corresponding to the naphthenate, was less intense than in the untreated crude. This showed that the metals were in the form of carboxylates and that metals removal had freed carboxylic acids.

We believe the following reaction has occurred:

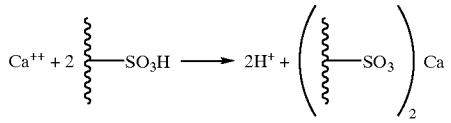

EXAMPLE 2

The reaction apparatus was the same as in Example 1. 50 g of Kome 6/1 crude was put into the reactor. Then 2.15 g of a copolymer of methacrylic acid with divinylbenzene, known under the commercial name of Amberlite IRP-64 and having a capacity of 10 milliequivalents/g, were added.

The mixture was stirred at 70° C. for 6 hours. Then the solid was separated by centrifugation and the crude was analyzed. The contents of Ca, Mn and Zn had dropped to 66, 2.2 and 0.7 ppm respectively.

We believe the following reaction has occurred:

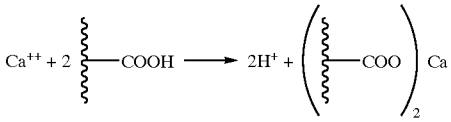

EXAMPLE 3

The reaction apparatus was the same as in Example 1. 50 g of Kome 6/1 crude were put into the apparatus. Then 7.6 g of a sulfonated styrene-divinylbenzene copolymer, having a capacity of 3.3 milliequivalents/gram and known under the commercial name of Amberlyst XN 1010 were added.

The mixture was stirred at 70° C. for 7 hours. After separation of the solids by centrifugation, the oil contained 147 ppm of Ca, 9 ppm of Mn and 0.7 ppm of Zn, i.e. much less than in the untreated Kome 6/1.

What is claimed is:

1. A process to remove a +2 ionic charged metal dissolved in an oil phase of a petroleum feed comprising (a) contacting said feed with an oil-insoluble resin that includes a group selected from the group consisting of carboxyl, sulfonic and phosphonic groups and combinations thereof, and (b) separating said resin from said petroleum feed, thereby lowering the metal concentration in said petroleum feed.

2. The process of claim 1 wherein said resins are crosslinked.

3. The process of claim 1 wherein said resin includes sulfonated styrene-divinylbenzene copolymers, methacrylic acid-divinylbenzene copolymers, polyacrylic acid, polyvinylsulfonic acid, phosphorylated styrene-divinylbenzene copolymers, polymethacrylic acid and styrene-divinylbenzene copolymers with attached iminodiacetic acid groups.

4. The process of claim 1 wherein said charged metal is a Group II metal.

5. The process of claim 1 wherein said charged metal is calcium.

6. The process of claim 1 wherein said resin is in the form of a bed through which said petroleum feed is passed.

7. The process of claim 1 wherein the resin is suspended in the petroleum feed and separated at the end of the treatment by filtration or centrifugation.

8. The process of claim 1 wherein said process is carried out at a temperature between 50° C. and 150° C.

9. The process of claim 1 wherein said charged metal is in the form of naphthenates.

10. The process of claim 1 wherein said charged metal is in the form of phenolates.

11. The process of claim 1 wherein said charged metal is in the form of chlorides.

12. The process of claim 1 wherein said charged metal is in the form of sulfates.

* * * * *